US011352735B2

(12) United States Patent
Yao et al.

(10) Patent No.: US 11,352,735 B2
(45) Date of Patent: Jun. 7, 2022

(54) FLUSHING DEVICE AND METHOD FOR AN EVAPORATOR OF DRYER AND DRYER

(71) Applicants: CHONGQING HAIER WASHING MACHINE CO., LTD., Shandong (CN); HAIER SMART HOME CO., LTD., Shangdong (CN)

(72) Inventors: Longping Yao, Shandong (CN); Zhaobin Du, Shandong (CN); Xinfeng Zhao, Shandong (CN); Jihai Wang, Shandong (CN)

(73) Assignees: CHONGQING HAIER WASHING MACHINE CO., LTD., Chongqing (CN); HAIER SMART HOME CO., LTD., Shangdong (CN)

( * ) Notice: Subject to any disclaimer, the term of this patent is extended or adjusted under 35 U.S.C. 154(b) by 196 days.

(21) Appl. No.: 16/609,185

(22) PCT Filed: Apr. 17, 2018

(86) PCT No.: PCT/CN2018/083280

§ 371 (c)(1),
(2) Date: Oct. 28, 2019

(87) PCT Pub. No.: WO2018/196648

PCT Pub. Date: Nov. 1, 2018

(65) Prior Publication Data

US 2020/0095722 A1 Mar. 26, 2020

(30) Foreign Application Priority Data

Apr. 28, 2017 (CN) ..... 201710294177.0

(51) Int. Cl.
*D06F 58/24* (2006.01)
*F28G 9/00* (2006.01)
(Continued)

(52) U.S. Cl.
CPC ..... *D06F 58/24* (2013.01); *F28G 9/00* (2013.01); *F28G 15/00* (2013.01); *D06F 58/22* (2013.01);
(Continued)

(58) Field of Classification Search
CPC ..... D06F 58/24; D06F 58/22; D06F 58/30; D06F 2103/50; D06F 2105/26; F28G 15/00; F28G 9/00; A47J 31/402; A63G 31/007
See application file for complete search history.

(56) References Cited

U.S. PATENT DOCUMENTS 5,820,471 A * 10/1998 Briggs ..... A63G 31/007 472/128
2010/0101606 A1* 4/2010 Grunert ..... D06F 58/22 134/11
2010/0243002 A1* 9/2010 Grunert ..... D06F 58/24 134/34

FOREIGN PATENT DOCUMENTS

CN 2133621 Y 5/1993
CN 2763365 Y 3/2006
(Continued)

OTHER PUBLICATIONS

International Search Report (PCT/ISA/210) dated Jun. 5, 2018, by the Chinese Patent Office as the International Searching Authority for International Application No. PCT/CN2018/083280.
(Continued)

*Primary Examiner* — Edelmira Bosques
*Assistant Examiner* — Bao D Nguyen
(74) *Attorney, Agent, or Firm* — Buchanan Ingersoll & Rooney PC

(57) ABSTRACT

The present disclosure provides a flushing device and method for an evaporator of dryer, and a dryer. The flushing device comprises an evaporator, a water storage box and a
(Continued)

condensate water pan for collecting condensate water, wherein an eccentric bucket is arranged between the water storage box and the evaporator, a supporting structure is arranged at two symmetrical sides of a periphery of the eccentric bucket, the supporting structure enables the eccentric bucket to turn over along with a change in the center of gravity of the eccentric bucket, a pipeline for conveying condensate water to the eccentric bucket is arranged between the eccentric bucket and the condensate water pan, an opening of the eccentric bucket is arranged upwards, and after the eccentric bucket is turned over, the opening of the eccentric bucket is aligned with the evaporator, such that condensate water in the eccentric bucket flushes the evaporator.

10 Claims, 1 Drawing Sheet

(51) Int. Cl.

| | |
|---|---|
| ***F28G 15/00*** | (2006.01) |
| *D06F 103/50* | (2020.01) |
| *D06F 105/26* | (2020.01) |
| *D06F 58/30* | (2020.01) |
| *D06F 58/22* | (2006.01) |

(52) U.S. Cl.
CPC ..... *D06F 58/30* (2020.02); *D06F 2103/50* (2020.02); *D06F 2105/26* (2020.02)

(56) References Cited

FOREIGN PATENT DOCUMENTS

| | | | |
|---|---|---|---|
| CN | 101652514 | A | 2/2010 |
| CN | 103882654 | A | 6/2014 |
| CN | 106480683 | A | 3/2017 |
| EP | 2947197 | A1 | 11/2015 |
| WO | 2009059874 | A1 | 5/2009 |
| WO | 2010102892 | A1 | 9/2010 |

OTHER PUBLICATIONS

Written Opinion (PCT/ISA/237) dated Jun. 5, 2018, by the Chinese Patent Office as the International Searching Authority for International Application No. PCT/CN2018/083280.
Extended European Search Report issued in corresponding EP Application 18791153, dated Mar. 19, 2020. 8 pages.
Chinese Search Report issued in corresponding CN Application 201710294177, dated Apr. 8, 2020. 2 Pages.
Chinese Office Action issued in corresponding CN Application 201710294177, dated Apr. 14, 2020. 12 Pages w/English Translation.

* cited by examiner

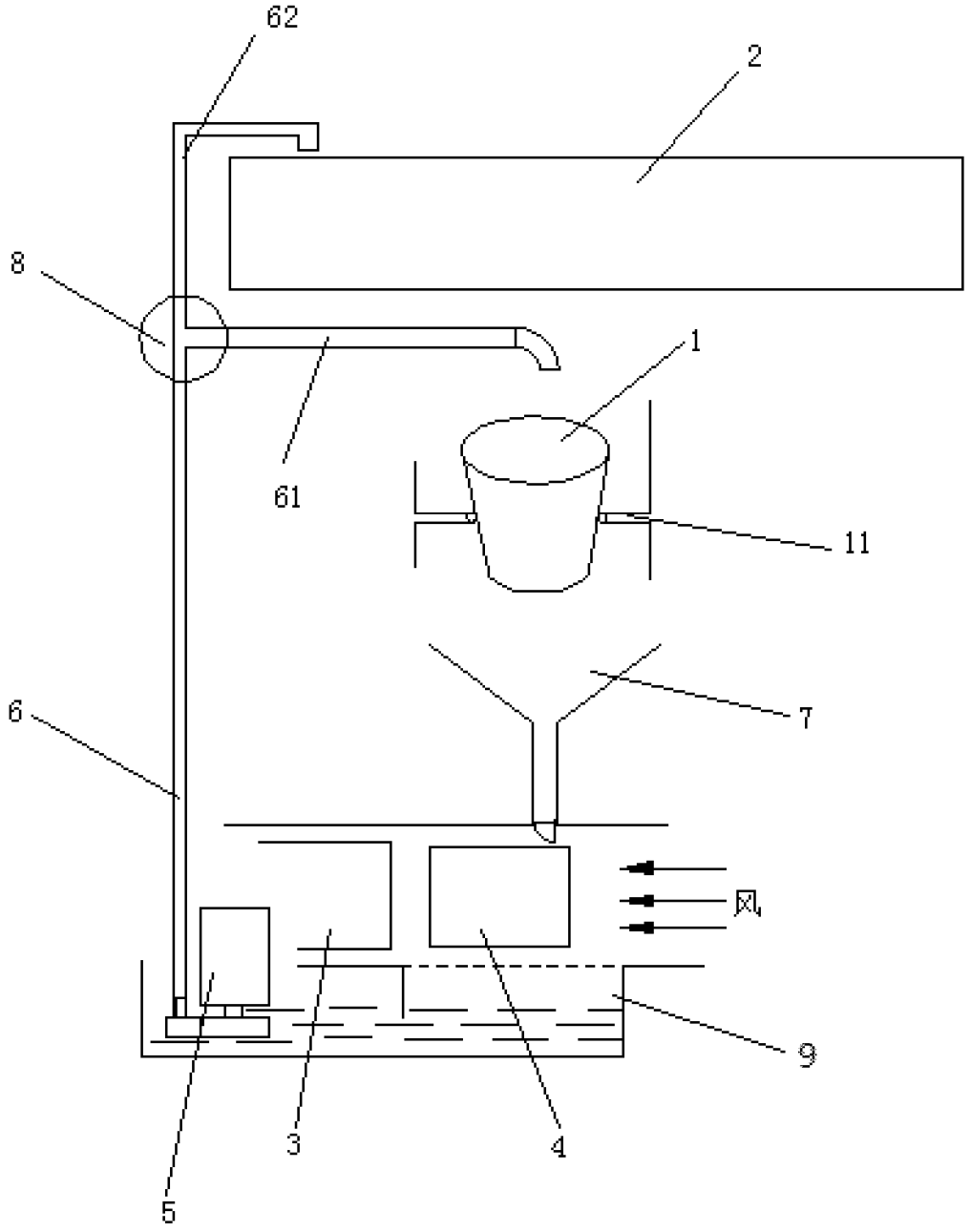
62
2
8
1
61
11
6
7
风
9
3
4
5

FLUSHING DEVICE AND METHOD FOR AN EVAPORATOR OF DRYER AND DRYER

TECHNICAL FIELD

The present disclosure belongs to a technical field of dryers, and specifically relates to a flushing device and method for an evaporator of dryer and a dryer.

BACKGROUND

In the prior art, a flushing device for an evaporator of dryer is complex in structure, needs tedious control procedures, and further needs the help of multiple electromagnetic valves and multiple metering structures, moreover, the cost of the flushing device is high, and the promotion and the application of the flushing device are difficult.

For example, patents WO2009059874 and WO2010102892 disclose a method for flushing an evaporator of a heat-pump dryer. In technical solutions of the two patents, a flushing liquid container is arranged above the evaporator. Patent WO2009059874 discloses that the flushing liquid container is suddenly opened to flush the evaporator, while patent WO2010102892 further defines to open the flushing liquid container by utilizing the electromagnetic valve so as to flush the evaporator. In the technical solutions of the two patents, the amount of flushing liquid flowing into the flushing liquid container and the time at which the electromagnetic valve is opened to flush the evaporator, need to be measured by means of assistant devices and procedures. In order to realize an object of flushing the evaporator, the internal structure and control procedures of the dryer are complicated, the cost is high. Moreover, complicated control of the control procedures easily leads to disorderliness, and is not beneficial for overall stability of the dryer, and easily leads to failure.

Therefore, a flushing device for an evaporator of dryer which is simple in structure and simplified in control method is urgently needed.

In view of this, the present application is hereby proposed.

SUMMARY

The technical problem to be solved in the present disclosure is to overcome the shortcomings of the prior art, and provides a flushing device for an evaporator of dryer. The flushing device for the evaporator of dryer is simple in structure, needs no tedious internal setting, sufficiently utilizes structural features of the existing dryer, and makes tedious to simple, and the flushing of the evaporator can be realized with no need of the control of the electromagnetic valve or the tedious measurement.

In order to solve the above technical problem and achieve the technical effect, a basic idea of the technical solution adopted in the present disclosure is as follows:

A flushing device for an evaporator of dryer includes an evaporator, a water storage box and a condensate water pan for collecting condensate water. An eccentric device for accommodating water is arranged between the water storage box and the evaporator, and a center of gravity of the eccentric device changes along with the amount of water in the eccentric device, such that the eccentric device is turned over to pour the water into the evaporator for flushing.

Preferably, an eccentric bucket is arranged between the water storage box and the evaporator. A supporting structure is arranged at two symmetrical sides of the periphery of the eccentric bucket. The supporting structure enables the eccentric bucket to turn over along with the change in the center of gravity of the eccentric bucket. A pipeline for conveying condensate water to the eccentric bucket is arranged between the eccentric bucket and the condensate water pan. The opening of the eccentric bucket is arranged upwards, and after the eccentric bucket is turned over, the opening of the eccentric bucket is aligned with the evaporator, such that condensate water in the eccentric bucket flushes the evaporator.

Preferably, a buffer diversion device is arranged between the eccentric bucket and the evaporator. The upper part of the buffer diversion device is upwards provided with an opening, for collecting condensate water poured by the eccentric bucket when the eccentric bucket is turned over, and the outlet of the buffer diversion device is opposite to the evaporator.

Preferably, the condensate water pan is provided with a first pipeline for conveying condensate water to the eccentric bucket and a second pipeline for conveying condensate water to the water storage box. The ratio of amounts of condensate water conveyed by the first pipeline and the second pipeline is M:N−M, wherein M is the amount of condensate water when the eccentric bucket is fully loaded, and N is the total amount of condensate water in the condensate water pan when the dryer operates for a single cycle.

Preferably, the first pipeline and the second pipeline are branched off from a main conveying pipeline. A flow splitting structure is arranged at a branched part of the main conveying pipeline. The flow splitting structure adjusts the ratio of the amounts of condensate water conveyed by the first pipeline and the second pipeline to be M:N−M.

Preferably, the first pipeline and the second pipeline are independently arranged, and are respectively configured with a separate conveying pump. The ratio of the amounts of condensate water conveyed by the first pipeline and the second pipeline is set to M:N−M by adjusting diameters of the first pipeline and the second pipeline or the setting of the conveying pump.

Preferably, the inner diameter of the buffer diversion device gradually decreases from the opening to the outlet of the buffer diversion device.

Another important object of the present disclosure is to provide a method for flushing an evaporator of dryer, wherein the dryer includes an evaporator, a water storage box and a condensate water pan for collecting condensate water. An eccentric bucket which is automatically turned over by utilizing the change in position of the center of gravity of the eccentric bucket is arranged between the water storage box and the evaporator. A pipeline for conveying condensate water into the eccentric bucket is arranged between the eccentric bucket and the condensate water pan. The opening of the eccentric bucket is arranged upwards. The opening of the eccentric bucket is aligned with the evaporator after the eccentric bucket is turned over, such that condensate water in the eccentric bucket flushes the evaporator;

The center of gravity of the eccentric bucket is arranged below a supporting point when the eccentric bucket is unloaded. The center of gravity of the eccentric bucket shifts to a position above the supporting point, the eccentric bucket is turned over, when the eccentric bucket is full of condensate water, flushes the evaporator with condensate water. When the condensate water in the eccentric bucket is dumped empty, the eccentric bucket is turned over to be restored to an unloaded state, and to enable the opening of the eccentric bucket to face upwards; the eccentric bucket is filled with condensate water again, and turned over again to dump the condensate water empty, and repeating all processes.

Preferably, the condensate water pan is provided with a first pipeline for conveying condensate water to the eccentric bucket and a second pipeline for conveying condensate water to the water storage box. The ratio of amounts of condensate water conveyed by the first pipeline and the second pipeline is adjusted to be M:N−M, such that the eccentric bucket is fully loaded and turned over to flush the evaporator when the dryer operates for a single cycle. Wherein M is the amount of condensate water when the eccentric bucket is fully loaded, and N is the total amount of condensate water in the condensate water pan when the dryer operates for a single cycle.

Preferably, the first pipeline and the second pipeline are branched off from a main conveying pipeline. A three-way pipe is arranged at a branched part of the main conveying pipeline. The diameter of the three-way pipe is adjusted to enable the ratio of the amounts of condensate water conveyed by the first pipeline and the second pipeline to be M:N−M, such that the eccentric bucket is fully loaded and turned over to flush the evaporator once when the dryer operates for a single cycle, and repeating all processes.

The method for flushing the evaporator of dryer in the present disclosure avoids tedious control by a computer and an electromagnetic valve, makes tedious to simple, has a favorable reliability, avoids the problem of disorderly control, can be realized only by means of simple structure, and is beneficial for decreasing failure rate.

Another important object of the present disclosure is to provide a dryer which is provided with any kind of the flushing device for the evaporator of dryer mentioned in the above content.

Compared with the prior art, the flushing device for the evaporator of dryer in the present disclosure has the following beneficial effects:

1. The own center of gravity of the eccentric bucket which arranged on the upper part of the evaporator of dryer changes along with the change of the amount of accommodated condensate water, makes the eccentric bucket turn over to flush the evaporator. Complex metering structure or electromagnetic valve structure are not need to be additionally set. The structure is simple and effective, and makes tedious to simple. The setting of the complex internal structure and lines of the dryer is avoided, and the failure rate of the dryer is reduced;

2. The conveying ratio of condensate water of the eccentric bucket is set according to the total amount of condensate water required by the dryer for operating for a cycle. The periodic and regular flushing of the evaporator is simply and effectively realized. Moreover, the metering of the electromagnetic valve and a computer control board is not needed, and the control procedures and methods are simplified;

3. The flushing device for the evaporator of dryer can be realized only through adding an eccentric bucket in the original dryer structure and slightly adjusting of the pipeline, thereby the R&D and production costs are reduced, and the market promotion and application is facilitated.

A further detailed description will be given below on specific implementations of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings:

FIG. 1 is a structural schematic diagram of the flushing device for the evaporator of dryer in embodiment 1 of the present disclosure.

In the drawings: 1, eccentric bucket, 2, water storage box, 3, condenser, 4, evaporator, 5, pump, 6, main conveying pipeline, 61, first pipeline, 62, second pipeline, 7, buffer diversion device, 8, flow splitting structure, 9, condensate water pan.

It should be noted that, these drawings and text descriptions are not aiming at limiting the conceptual scope of the present disclosure in any form, but to describe the concept of the present disclosure to those skilled in the art with reference to specific embodiments.

DETAILED DESCRIPTION

In order to make the object, technical solutions and advantages of the present disclosure clearer, a clear and complete description will be given below on technical solutions in the embodiment in combination with accompanying drawings in embodiments of the present disclosure. The following embodiments are used for describing the present disclosure, rather than for limiting the scope of the present disclosure.

In the description of the present disclosure, it should be noted that, the directional or positional relationship indicated by such terms as "upper", "lower", "front", "rear", "left", "right", "vertical", "inner" and "outer" is the directional or positional relationship shown based on the drawings, which is merely for convenient and simplified description of the present disclosure, rather than indicating or implying that the referred device or element must have the specific direction or must be constructed and operated in the specific direction, therefore, it cannot be understood as a limitation to the present disclosure.

In the description of the present disclosure, it should be noted that, unless otherwise prescribed and defined definitely, the terms "installation", "interconnection" and "connection" should be understood in its broad sense. For example, the "connection" may be a fixed connection, may also be a detachable connection or an integrated connection; and the "connection" may be a mechanical connection, may also be an electrical connection; and the "interconnection" may be a directly interconnection, may also be an indirectly interconnection through an intermediate medium. The specific meaning of the above-mentioned terms in the present disclosure may be understood by those of ordinary skill in the art in light of specific circumstances.

Embodiment 1

A flushing device for an evaporator of dryer includes an evaporator 4, a water storage box 2 and a condensate water pan 9 for collecting condensate water. An eccentric device for accommodating water is arranged between the water storage box 2 and the evaporator 4, and a center of gravity of the eccentric device changes along with the amount of water in the eccentric device, such that the eccentric device is turned over to pour the water into the evaporator 4 for flushing.

Specifically, the eccentric device in the present embodiment is set to be an eccentric bucket 1:

A flushing device for an evaporator of dryer includes an evaporator 4, a water storage box 2 and a condensate water pan 9 for collecting condensate water. An eccentric bucket 1 is arranged between the water storage box 2 and the evaporator 4. A supporting structure is arranged at two symmetrical sides of the periphery of the eccentric bucket 1. The supporting structure enables the eccentric bucket 1 to turn over along with the change in the center of gravity of the eccentric bucket 1. A pipeline for conveying condensate water to the eccentric bucket 1 is arranged between the eccentric bucket 1 and the condensate water pan 9. An opening of the eccentric bucket 1 is arranged upwards, and after the eccentric bucket 1 is turned over, the opening of the eccentric bucket 1 is aligned with the evaporator 4, such that condensate water in the eccentric bucket 1 flushes the evaporator 4.

A buffer diversion device 7 is arranged between the eccentric bucket 1 and the evaporator 4. The upper part of the buffer diversion device 7 is upwards provided with an opening, for collecting condensate water poured by the eccentric bucket 1 when the eccentric bucket 1 is turned over, and the outlet of the buffer diversion device 7 is opposite to the evaporator 4.

The operating principles based on which an eccentric bucket 1 realizes flushing is as follows:

The eccentric bucket 1 is arranged above the evaporator 4. The supporting structure of the eccentric bucket 1 enables the eccentric bucket 1 to be turned over according to the change of the center of gravity of the eccentric bucket 1, thereby being simple and speedy. The supporting structure can adopt a bearing and a pulley, etc.

When the eccentric bucket 1 is unloaded, the center of gravity of the eccentric bucket 1 is arranged below a supporting point of the supporting structure. When the eccentric bucket 1 is full of condensate water, the center of gravity of the eccentric bucket 1 shifts to a position oblique above the supporting point, the eccentric bucket 1 is turned over by unstable, condensate water flushes onto the evaporator 4. Since the condensate water is dumped empty, the eccentric bucket 1 is restored to a state of empty bucket, the eccentric bucket 1 is turned over to enable the opening to face upwards. The eccentric bucket 1 is filled with condensate water again, and is turned over again to flush the evaporator 4, and repeating all processes.

The condensate water pan 9 is provided with a first pipeline 61 for conveying condensate water to the eccentric bucket 1 and a second pipeline 62 for conveying condensate water to the water storage box 2. The ratio of amounts of condensate water conveyed by the first pipeline 61 and the second pipeline 62 is M:N−M, wherein M is the amount of condensate water when the eccentric bucket 1 is fully loaded, and N is the total amount of condensate water in the condensate water pan 9 when the dryer operates for a single cycle.

The first pipeline 61 and the second pipeline 62 are branched off from a main conveying pipeline 6. A flow splitting structure 8 is arranged at a branched part of the main conveying pipeline 6. The flow splitting structure 8 adjusts the ratio of the amounts of condensate water conveyed by the first pipeline 61 and the second pipeline 62 to be M:N−M.

In order to realize periodic and regular flushing of the evaporator 4, and in combination with the operating features of a condensing dryer, a three-way pipe or a three-way valve can be arranged on a conveying pipeline of condensate water to realize flow splitting of condensate water. The adjustment of the diameter of the three-way pipe or the setting of the three-way valve enables the eccentric bucket 1 to be full of condensate water once during each standard drying cycle (namely, an operating cycle) of the dryer, thereby realizes the flushing of the evaporator 4 once.

For example, the condensate water obtained in one standard drying cycle of the dryer is supposed to be 10 units, and the volume of the eccentric bucket is supposed to be 1 unit, then the ratio of condensate water of a main conveying pipeline 6, a second pipeline 62 and a first pipeline 61 of the three-way pipe is designed to be 10:9:1. 1 unit of water is realized to enter into an eccentric bucket, to ensure that the evaporator 4 is flushed once during one clothes drying cycle, therefore, flushing is regular and orderly. The controlling of the electromagnetic valve or the metering of the computer board is not needed, the structure is simple, and the realization method is simple and effective.

The inner diameter of the buffer diversion device 7 gradually decreases from the opening to the outlet of the buffer diversion device 7.

The buffer diversion device 7 in the present embodiment is a funnel. An opening of the funnel can collect condensate water which is poured when the eccentric bucket 1 is turned over, so as to avoid splashing of condensate water all around. Meanwhile, the lower end of the funnel is provided with a neck part which has a small inner diameter, the lower end of the neck part is provided with an inclined surface structure. The condensate water speeds up when the condensate water flows downwards from the upper part of the funnel, thereby achieving a better effect of flushing the evaporator 4, and reducing splashing of water all around.

The buffer diversion device 7 can realize multiple beneficial effects of speeding up water and avoiding splashing of water all around. The device for speeding up water does not need to be additionally added, thereby being convenient and effective.

The present embodiment further provides a method for flushing an evaporator of dryer, wherein the dryer includes an evaporator 4, a water storage box 2 and a condensate water pan 9 for collecting condensate water. An eccentric bucket 1 which is automatically turned over by utilizing the change in position of the center of gravity of the eccentric bucket 1 is arranged between the water storage box 2 and the evaporator 4. A pipeline for conveying condensate water into the eccentric bucket 1 is arranged between the eccentric bucket 1 and the condensate water pan 9. The opening of the eccentric bucket 1 is arranged upwards. After the eccentric bucket 1 is turned over, the opening of the eccentric bucket 1 is aligned with the evaporator 4, such that condensate water in the eccentric bucket 1 flushes the evaporator 4;

when the eccentric bucket 1 is unloaded, the center of gravity of the eccentric bucket 1 is arranged below a supporting structure. When the eccentric bucket is full of condensate water, the center of gravity of the eccentric bucket 1 shifts to a position above the supporting point, the eccentric bucket 1 is turned over; condensate water flushes the evaporator 4. When the condensate water in the eccentric bucket 1 is dumped empty, the eccentric bucket 1 is restored to an unloaded state, and is turned over to enable the opening of the eccentric bucket 1 to face upwards; the eccentric bucket 1 is filled with condensate water again, and is turned over again to dump the condensate water empty, and repeating all processes.

The condensate water pan 9 is provided with a first pipeline 61 for conveying condensate water to the eccentric bucket 1 and a second pipeline 62 for conveying condensate water to the water storage box 2. The ratio of amounts of condensate water conveyed by the first pipeline 61 and the second pipeline 62 is adjusted to be M:N−M, such that the eccentric bucket 1 is fully loaded and turned over to flush the evaporator 4 when the dryer operates for a single cycle. Wherein M is the amount of condensate water when the eccentric bucket 1 is fully loaded, and N is the total amount of condensate water in the condensate water pan 9 when the dryer operates for a single cycle.

The first pipeline 61 and the second pipeline 62 are branched off from a main conveying pipeline 6. A three-way pipe is arranged at a branched part of the main conveying pipeline 6. The diameter of the three-way pipe is adjusted to enable the ratio of the amounts of condensate water conveyed by the first pipeline 61 and the second pipeline 62 to be M:N−M, such that the eccentric bucket 1 is fully loaded and is turned over to flush the evaporator 4 once when the dryer operates for a single cycle, and repeating all processes.

The above method for flushing the evaporator of dryer avoids tedious control by a computer and an electromagnetic valve, makes tedious to simple, has a favorable reliability, avoids the problem of disorderly control, can be realized only by means of a simple structure, and is beneficial for decreasing failure rate.

The present embodiment further provides a dryer which is provided with the flushing device for the evaporator of dryer mentioned in the above content.

Compared with the prior art, the flushing device for the evaporator of dryer has the following beneficial effects:

1. The own center of gravity of the eccentric bucket which arranged on the upper part of the evaporator of dryer changes along with the change of the amount of accommodated condensate water, makes the eccentric bucket turn over to flush the evaporator. Complex metering structure or electromagnetic valve structure are not need to be additionally set. The structure is simple and effective, and makes tedious to simple. The setting of the complex internal structure and lines of the dryer is avoided, and the failure rate of the dryer is reduced;

2. The conveying ratio of condensate water of the eccentric bucket is set according to the total amount of condensate water required by the dryer for operating for a cycle. The periodic and regular flushing of the evaporator is simply and effectively realized. Moreover, the metering of the electromagnetic valve and a computer control board is not needed, and the control procedures and methods are simplified;

3. The flushing device for the evaporator of dryer can be realized only through adding an eccentric bucket in the original dryer structure and slightly adjusting of the pipeline, thereby the R&D and production costs are reduced, and the market promotion and application is facilitated.

Embodiment 2

The present embodiment differs from embodiment 1 as follows:

The first pipeline 61 and the second pipeline 62 are independently arranged, and are respectively configured with a separate pump 5. The ratio of the amounts of condensate water conveyed by the first pipeline 61 and the second pipeline 62 is set to M:N−M by adjusting diameters of the first pipeline 61 and the second pipeline 62 or the setting of the pump 5. No drawing is given in the application of the present disclosure.

A flushing device for an evaporator of dryer includes an evaporator 4, a water storage box 2 and a condensate water pan 9 for collecting condensate water. An eccentric bucket 1 is arranged between the water storage box 2 and the evaporator 4. A supporting structure is arranged at two symmetrical sides of the periphery of the eccentric bucket 1. The supporting structure enables the eccentric bucket 1 to turn over along with the change in the center of gravity of the eccentric bucket 1. A pipeline for conveying condensate water to the eccentric bucket 1 is arranged between the eccentric bucket 1 and the condensate water pan 9. An opening of the eccentric bucket 1 is arranged upwards, and after the eccentric bucket 1 is turned over, the opening of the eccentric bucket 1 is aligned with the evaporator 4, such that condensate water in the eccentric bucket 1 flushes the evaporator 4.

A buffer diversion device 7 is arranged between the eccentric bucket 1 and the evaporator 4. The upper part of the buffer diversion device 7 is upwards provided with an opening, for collecting condensate water poured by the eccentric bucket 1 when the eccentric bucket 1 is turned over, and the outlet of the buffer diversion device 7 is opposite to the evaporator 4.

The operating principles based on which an eccentric bucket 1 realizes flushing is as follows:

The eccentric bucket 1 is arranged above the evaporator 4. The supporting structure of the eccentric bucket 1 enables the eccentric bucket 1 to be turned over according to the change of the center of gravity of the eccentric bucket 1, thereby being simple and speedy. The supporting structure can adopt a bearing and a pulley, etc.

When the eccentric bucket 1 is unloaded, the center of gravity of the eccentric bucket 1 is arranged below a supporting point of the supporting structure. When the eccentric bucket 1 is full of condensate water, the center of gravity of the eccentric bucket 1 shifts to a position oblique above the supporting point, the eccentric bucket 1 is turned over by unstable, condensate water flushes onto the evaporator 4. Since the condensate water is dumped empty, the eccentric bucket 1 is restored to a state of empty bucket, the eccentric bucket 1 is turned over to enable the opening to face upwards. The eccentric bucket 1 is filled with condensate water again, and is turned over again to flush the evaporator 4, and repeating all processes.

The condensate water pan 9 is provided with a first pipeline 61 for conveying condensate water to the eccentric bucket 1 and a second pipeline 62 for conveying condensate water to the water storage box 2. The ratio of the amounts of condensate water conveyed by the first pipeline 61 and the second pipeline 62 is M:N−M, wherein M is the amount of condensate water when the eccentric bucket 1 is fully loaded, and N is the total amount of condensate water in the condensate water pan 9 when the dryer operates for a single cycle.

The first pipeline 61 and the second pipeline 62 are independently arranged, and are respectively configured with a separate pump 5. The ratio of the amounts of condensate water conveyed by the first pipeline 61 and the second pipeline 62 is set to M:N−M by adjusting diameters of the first pipeline 61 and the second pipeline 62 or the setting of the pump 5.

In order to realize periodic and regular flushing of the evaporator 4 and in combination with the operating features of a condensing dryer, the first pipeline 61 and the second pipeline 62 can be respectively arranged separately and configured with a separate pump 5. The adjustment of the diameter of the first pipeline 61 and the second pipeline 62 or the setting of the pump 5 enables the ratio of the amounts of condensate water conveyed by the first pipeline 61 and the second pipeline 62 to be M:N−M, to realize conveying of condensate water in ratio. The eccentric bucket 1 is enabled to be full of condensate water once during each standard drying cycle (namely, an operating cycle) of the dryer, and realizes the flushing of the evaporator 4 once.

For example, the condensate water obtained in one standard drying cycle of the dryer is supposed to be 10 units, and the volume of the eccentric bucket is supposed to be 1 unit, then the ratio of condensate water of the second pipeline 62 and the first pipeline 61 is designed to be 9:1. 1 unit of water is realized to enter into an eccentric bucket, to ensure that the evaporator 4 is flushed once during one clothes drying cycle, therefore, flushing is regular and orderly. The controlling of the electromagnetic valve or the metering of the computer board is not needed, the structure is simple, and the realization method is simple and effective.

The inner diameter of the buffer diversion device 7 gradually decreases from the opening to the outlet of the buffer diversion device 7.

The buffer diversion device 7 in the present embodiment is a funnel. An opening of the funnel can collect condensate water which is poured when the eccentric bucket 1 is turned over, so as to avoid splashing of condensate water all around. Meanwhile, the lower end of the funnel is provided with a neck part which has a small inner diameter, the lower end of the neck part is provided with an inclined surface structure. The condensate water speeds up when the condensate water flows downwards from the upper part of the funnel, thereby achieving a better effect of flushing the evaporator 4, and reducing splashing of water all around.

The buffer diversion device 7 can realize multiple beneficial effects of speeding up water and avoiding splashing of water all around. The device for speeding up water does not need to be additionally added, thereby being convenient and effective.

The present embodiment further provides a method for flushing an evaporator of dryer, wherein the dryer includes an evaporator 4, a water storage box 2 and a condensate water pan 9 for collecting condensate water. An eccentric bucket 1 which is automatically turned over by utilizing the change in position of the center of gravity of the eccentric bucket 1 is arranged between the water storage box 2 and the evaporator 4. A pipeline for conveying condensate water into the eccentric bucket 1 is arranged between the eccentric bucket 1 and the condensate water pan 9. The opening of the eccentric bucket 1 is arranged upwards. the opening of the eccentric bucket 1 is aligned with the evaporator 4, after the eccentric bucket 1 is turned over, such that condensate water in the eccentric bucket 1 flushes the evaporator 4;

the center of gravity of the eccentric bucket 1 is arranged below a supporting point at which a supporting structure is in contact with the eccentric bucket 1 when the eccentric bucket 1 is unloaded. The center of gravity of the eccentric bucket 1 shifting to a position above the supporting point, the eccentric bucket 1 is turned over; when the eccentric bucket is full of condensate water, flushes the evaporator 4 with condensate water. Condensate water in the eccentric bucket 1 is dumped empty, the eccentric bucket 1 is turned over to be restored to an unloaded state, and to enable the opening of the eccentric bucket 1 to face upwards, the eccentric bucket 1 is filled with condensate water again, and turned over again to dump the condensate water empty, and repeating all processes.

The condensate water pan 9 is provided with a first pipeline 61 for conveying condensate water to the eccentric bucket 1 and a second pipeline 62 for conveying condensate water to the water storage box 2. The ratio of the amounts of condensate water conveyed by the first pipeline 61 and the second pipeline 62 is adjusted to be M:N−M, such that the eccentric bucket 1 is fully loaded and turned over to flush the evaporator 4 when the dryer operates for a single cycle. Wherein M is the amount of condensate water when the eccentric bucket 1 is fully loaded, and N is the total amount of condensate water in the condensate water pan 9 when the dryer operates for a single cycle.

The first pipeline 61 and the second pipeline 62 are independently arranged, and are respectively configured with a separate pump 5. The ratio of the amounts of condensate water conveyed by the first pipeline 61 and the second pipeline 62 is set to M:N−M by adjusting diameters of the first pipeline 61 and the second pipeline 62 or the setting of the pump 5, such that the eccentric bucket 1 is fully loaded and turned over to flush the evaporator 4 once when the dryer operates for a single cycle, and repeating all processes.

The above method for flushing the evaporator of dryer avoids tedious control by a computer and an electromagnetic valve, makes tedious to simple, has a favorable reliability, avoids the problem of disorderly control, can be realized only by means of a simple structure, and is beneficial for decreasing failure rate.

Compared with the prior art, the flushing device for the evaporator of dryer has the following beneficial effects:

1. The own center of gravity of the eccentric bucket which arranged on the upper part of the evaporator of dryer changes along with the change of the amount of accommodated condensate water, makes the eccentric bucket turn over to flush the evaporator. Complex metering structure or electromagnetic valve structure are not need to be additionally set. The structure is simple and effective, and makes tedious to simple. The setting of the complex internal structure and lines of the dryer is avoided, and the failure rate of the dryer is reduced;

2. The conveying ratio of condensate water of the eccentric bucket is set according to the total amount of condensate water required by the dryer for operating for a cycle. The periodic and regular flushing of the evaporator is simply and effectively realized. Moreover, the metering of the electromagnetic valve and a computer control board is not needed, and the control procedures and methods are simplified;

3. The flushing device for the evaporator of dryer can be realized only through adding an eccentric bucket in the original dryer structure and slightly adjusting of the pipeline, thereby the R&D and production costs are reduced, and the market promotion and application is facilitated.

The above-mentioned embodiments are only the preferred embodiments of the present disclosure, but not intended to limit the present disclosure in any form. Although the present disclosure has been described in terms of preferred embodiments, it is not intended to be limited to these disclosed embodiments. Equivalent embodiments, of which some changes or modifications are equivalent changes, may be made by any skilled in the art by using the above-mentioned technical contents without departing from the technical scheme scope of the present disclosure. However, all simple amendments, equivalent changes and modifications made to the above embodiments according to the technical essence of the present disclosure without departing from the technical scheme scope of the present disclosure all still fall within the protection scope of the present disclosure.

The invention claimed is:

1. A flushing device for an evaporator of a dryer having an evaporator, a water storage box and a condensate water pan for collecting condensate water, the flushing device comprising:

an eccentric bucket for accommodating water arranged between the water storage box and the evaporator;

a supporting structure arranged at two symmetrical sides of a periphery of the eccentric bucket, the supporting structure enables the eccentric bucket to turn over along with a change in a center of gravity of the eccentric bucket;

a main conveying pipeline for conveying the condensate water to the eccentric bucket from the condensate water pan, wherein the flushing device is configured so that an opening of the eccentric bucket is arranged upwards, and after the eccentric bucket is turned over, the opening of the eccentric bucket is aligned with the evaporator, such that the condensate water in the eccentric bucket flushes the evaporator, the main conveying pipeline is connected with a first pipeline for conveying the condensate water to the eccentric bucket and a second pipeline for conveying the condensate water to the water storage box, and a ratio of amounts of the condensate water conveyed by the first pipeline and the second pipeline is M:N−M, wherein M is the amount of the condensate water when the eccentric bucket is fully loaded, and N is a total amount of the condensate water in the condensate water pan when the dryer operates for a single cycle.

2. The flushing device for the evaporator of the dryer according to claim 1, comprising:

a buffer diversion device arranged between the eccentric bucket and the evaporator, an upper part of the buffer diversion device is upwards provided with an opening, for collecting condensate water poured by the eccentric bucket when the eccentric bucket is turned over, and an outlet of the buffer diversion device is opposite to the evaporator.

3. The flushing device for the evaporator of dryer according to claim 2, wherein the first pipeline and the second pipeline are branched off from the main conveying pipeline, a flow splitting structure is arranged at a branched part of the main conveying pipeline, and the flow splitting structure adjusts the ratio of the amounts of the condensate water conveyed by the first pipeline and the second pipeline to be M:N−M.

4. The flushing device for the evaporator of dryer according to claim 3, wherein an inner diameter of the buffer diversion device gradually decreases from the opening to the outlet of the buffer diversion device.

5. The flushing device for the evaporator of dryer according to claim 2, wherein the first pipeline and the second pipeline are independently arranged, and are respectively configured to be communicated with a pump via the main conveying pipeline, and the ratio of the amounts of the condensate water conveyed by the first pipeline and the second pipeline is set to M:N−M by adjusting diameters of the first pipeline and the second pipeline.

6. The flushing device for the evaporator of dryer according to claim 5, wherein an inner diameter of the buffer diversion device gradually decreases from the opening to the outlet of the buffer diversion device.

7. The flushing device for the evaporator of dryer according to claim 2, wherein an inner diameter of the buffer diversion device gradually decreases from the opening to the outlet of the buffer diversion device.

8. A method for flushing an evaporator of a dryer including the evaporator, a water storage box, a condensate water pan for collecting condensate water, and a flushing device for the evaporator, the method comprising:

arranging an eccentric bucket for accommodating water between the water storage box and the evaporator and supported by a supporting structure arranged at two symmetrical sides of a periphery of the eccentric bucket, the supporting structure enables the eccentric bucket to turn over along with a change in a center of gravity of the eccentric bucket;

conveying condensate water to the eccentric bucket from the condensate water pan via a main conveying pipeline, wherein the flushing device is configured so that an opening of the eccentric bucket is arranged upwards; and turning the eccentric bucket over so that the opening of the eccentric bucket is aligned with the evaporator, such that condensate water in the eccentric bucket flushes the evaporator, conveying the condensate water to the eccentric bucket from the main conveying pipeline pan via a first pipeline and conveying the condensate water to the water storage box from the main conveying pipeline via a second pipeline, wherein a ratio of amounts of the condensate water conveyed by the first pipeline and the second pipeline is M:N−M, wherein M is the amount of the condensate water when the eccentric bucket is fully loaded, and N is a total amount of the condensate water in the condensate water pan when the dryer operates for a single cycle.

9. The method for flushing the evaporator of a dryer according to claim 8, wherein the first pipeline and the second pipeline are branched off from the main conveying pipeline, a three-way pipe is arranged at a branched part of the main conveying pipeline, and a diameter of the three-way pipe is adjusted to enable the ratio of the amounts of the condensate water conveyed by the first pipeline and the second pipeline to be M:N−M, such that the eccentric bucket is fully loaded and turned over to flush the evaporator once when the dryer operates for the single cycle, and repeating all processes.

10. A dryer, comprising:

an evaporator;

a water storage box;

a condensate water pan for collecting condensate water; and a flushing device for the evaporator, the flushing device including:

an eccentric bucket for accommodating water and arranged between the water storage box and the evaporator;

a supporting structure arranged at two symmetrical sides of a periphery of the eccentric bucket, the supporting structure enables the eccentric bucket to turn over along with a change in a center of gravity of the eccentric bucket;

a main conveying pipeline for conveying the condensate water to the eccentric bucket from the condensate water pan, wherein the flushing device is configured so that an opening of the eccentric bucket is arranged upwards, and after the eccentric bucket is turned over, the opening of the eccentric bucket is aligned with the evaporator, such that the condensate water in the eccentric bucket flushes the evaporator, the main conveying pipeline is connected with a first pipeline for conveying the condensate water to the eccentric bucket and a second pipeline for conveying the condensate water to the water storage box, and a ratio of amounts of the condensate water conveyed by the first pipeline and the second pipeline is M:N−M, wherein M is the amount of the condensate water when the eccentric bucket is fully loaded, and N is a total amount of the condensate water in the condensate water pan when the dryer operates for a single cycle.

* * * * *